United States Patent [19]

Bialkowski

[11] Patent Number: 4,675,482

[45] Date of Patent: Jun. 23, 1987

[54] SWITCH CONTACT FOR A VACUUM SWITCHING TUBE

[75] Inventor: Guenter Bialkowski, Berlin, Fed. Rep. of Germany

[73] Assignee: Siemens Aktiengesellschaft, Berlin and Munich, Fed. Rep. of Germany

[21] Appl. No.: 788,636

[22] Filed: Oct. 17, 1985

[30] Foreign Application Priority Data

Dec. 18, 1984 [DE] Fed. Rep. of Germany ..... 3446164

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,196,327 4/1980 Kurosawa et al. ..... 200/144 B

FOREIGN PATENT DOCUMENTS 0055008 6/1982 European Pat. Off. ..... 200/144 B 2207242 8/1972 Fed. Rep. of Germany ... 200/144 B

*Primary Examiner*—Robert S. Macon

*Attorney, Agent, or Firm*—Hill, Van Santen, Steadman & Simpson

[57] ABSTRACT

For generating an axial magnetic field over the contact surfaces in vacuum switching tubes, conductor loops which are constructed in a fashion similar to a spoked wheel are disposed following the contact members. In order to dimension such conductor loops with a low cross-section and in order to also be able to manufacture them in a simple fashion, it is proposed that the conductor loops contain at least approximately circular sector-shaped terminals, that these terminals merge into webs and that terminals following one another in circumferential direction are alternately connected electrically conductive in low-resistant fashion to the end face of a stud or to the terminal surface of a contact member.

9 Claims, 5 Drawing Figures

SWITCH CONTACT FOR A VACUUM SWITCHING TUBE

BACKGROUND OF THE INVENTION

1. Field of the Invention

The present invention relates to a switch contact for a vacuum switching tube.

2. Description of the Prior Art

A switch contact for a vacuum switching tube is disclosed by U.S. Pat. No. 4,196,327 comprising a means for generating an axial magnetic field which comprises a stud and a contact member having at least one contact surface and contains two or more conductor loops at the side facing away from the contact surface, whereby the conductor loops generate a magnetic field proceeding in axial direction over the contact surface, whereby the conductor loops proceed from the stud and return to a region of the switch member close to the axis and comprise terminals separated from one another by a slot, whereby the terminals of the conductor loops are supported in the direction toward and in the proximity of the axis of the stud by a supporting member having poor electrical conductivity or no electrical conductivity and whereby the conductor loops are connected to one another of one piece at least in their part remote from the axis. Essentially two embodiments can be derived from this patent, one embodiment allowing the current to pass into a contact member in the region of the outer circumference, and a second embodiment which returns the current into the proximity of the rotational axis of the contact and allows it to pass there into corresponding contact surfaces of the contact member.

The first of the embodiments which allows the current to pass into the contact member in the region of the outer circumference of the conductor loop yields a field strength of the axial magnetic field which is dependent on the distance of the arc from the edge of the conductor loop. This non-uniformity of the magnetic field is undesirable. The second embodiment avoids this non-uniformity of the magnetic field but is relatively involved in terms of manufacture, since a horizontal slot must be manufactured within a ring, a special tool being required for this purpose. This embodiment, on the other hand, does not allow a dimensioning to maximum load of the material since the webs leading to the center of the ring and, thus, to the contact surfaces can only comprise a small part of the height of the conductor loops in the region of the circumference. An extremely wide construction of the webs would inadmissably diminish the area permeated by the axial field. Thus, a high weight of the conductor loop in comparison to the power must be accepted given this embodiment.

SUMMARY OF THE INVENTION

An object of the present invention is to make a switch contact as described above simpler to manufacture, to design the conductor loops mechanically stable and, thereby, to reduce their weight given the same size and loadability of the contact piece and to cover a large part of the contact surface with the generated axial field.

This object is achieved by providing the conductor loops with at least approximately circular sector-shaped terminals, having their terminals merge into webs which belong to two neighboring conductor loops, having terminals following one another in circumferential direction be alternatively connected electrically conductive in low-resistant fashion to the end face of the stud or to the terminal surface of the contact member, and having the slots between the terminals separate at the end face not contacted in low-resistant fashion. As a result of the distributed arrangement of the terminals of the conductor loops over the end face of the stud over a corresponding contact surface of the contact member, the webs of the conductor loops can have an extent in axial direction which is independent of the height of their part remote from the axis. Their cross-section can therefore be designed for maximum current load in every subsection.

In the framework of the loadability of the contact surfaces, the slots which separate the contact surfaces can also be placed obliquely or asymmetrically insofar as contact surfaces lying next to one another arise in circumferential direction and supporting surfaces arise at the non-contacted end face. A simple fabrication is guaranteed when the slots lie parallel to a plane which contains the rotational axis of the switch contact. A symmetrical embodiment which is therefore particularly highly loadable is achieved when the symmetry plane of the slots contains the rotational axis of the switch contacts. In order to be able to advantageously transmit the mechanical forces during the switching event, an embodiment is advantageous in which intermediate plys having low electrical conductivity are disposed at that side of the terminals not contacted low-resistant. Such intermediate plys can be of ceramic or can also be of high-resistant metal, for example of rust-resistant steel. From a mechanical point of view, they are only stressed for pressure. The conductor loops are advantageously composed of a common circular ring and of webs applied thereto, whereby the webs have the same extent in axial direction as the circular ring. The webs thereby preferably comprise twice the width of the circular ring, so that the webs and the circular ring are identically loaded given uniform current load of all loops.

In order to obtain a planar surface of the conductor loops and in order to enable the smallest possible clearance to the contact member, it is advantageous when the supporting surfaces are set back in axial direction relative to the surface of neighboring terminals and when the intermediate plys terminate in axial direction in a plane with the neighboring terminals. Herein, the intermediate plys are advantageously inserted in the form of laminae in corresponding depressions or, respectively, the set-back parts of the terminals. The set-back parts of the terminals can be applied by cutting deformation, by stamping or, under given conditions, during casting of the conductor loops.

Insofar as the stud must be essentially dimensioned based on the current loadability and not principly based on the mechanical stability, it is advantageous that a part adjoining the end face and having an enlarged cross-section is applied to the stud and that the terminals of the conductor loops cover this enlarged cross-section. A thermal overload of the material is thereby also avoided in the region of the current transfer from the stud to the terminals of the conductor loops, even though only a part of the end face of the stud is available in this region for low-resistance contacting of the terminals.

BRIEF DESCRIPTION OF THE DRAWINGS

The invention shall now be explained in greater detail with reference to the drawings. It is to be understood that the invention is not limited to the example shown in the figures.

DESCRIPTION OF THE PREFERRED EMBODIMENTS

Figure 1:
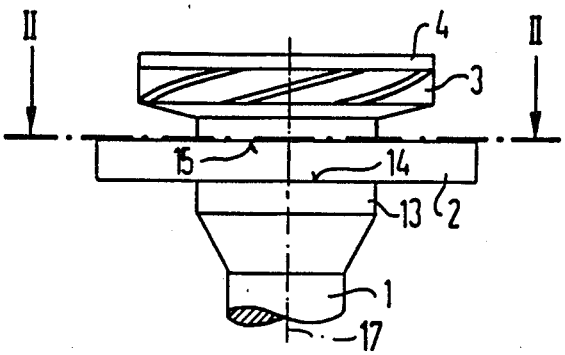
FIG. 1 shows a switch contact of the invention in a partially broken view.
Figure 2:
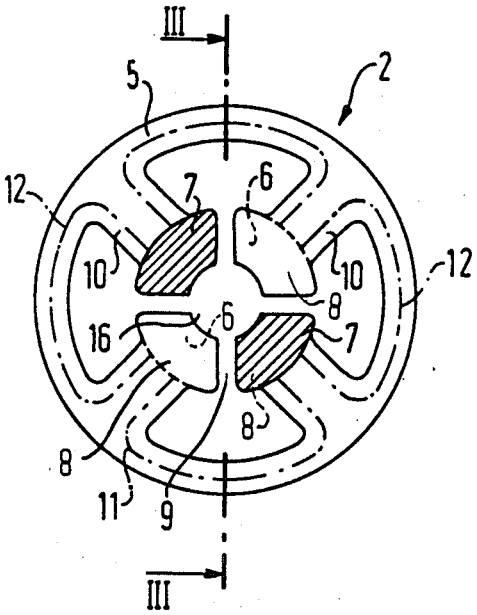
FIG. 2 is a sectional view of the switch contact taken generally along the line II—II of FIG. 1.
Figure 3:
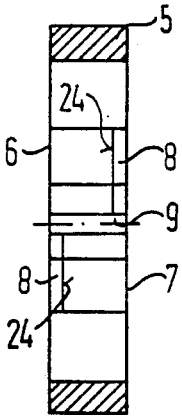
FIG. 3 is a sectional view of the switch contact taken generally along the line III—III of FIG. 2.

As illustrated in FIGS. 1–3, stud 1 includes a part 13 with enlarged cross-section which is adjacent to its end face 14. An arrangement 2 of conductor loops 11, 12 is attached to the end face 14 of the stud 1. Terminals 6 of the conductor loops 11, 12 are connected electrically conductive in a low-resistant fashion to the end face 14 of the stud 1, for example, are welded to the end face 14. A terminal surface 15 of a contact member 3 is put in place on the terminal surface 15 of the arrangement 2 of conductor loops 11, 12. The contact member 3 is connected, for example welded, electrically conductive in low-resistant fashion to the terminals 7 of the conductor loops 11, 12 (FIG. 2).

The terminals 6, 7 are mechanically supported via intermediate plys 8 having poor conductivity or no conductivity, being supported against the end face 14 of the stud 1 or against the terminal surface 15 of the contact member 3 at its respective sides and being mechanically connected to the terminals 6, 7 at the supporting surfaces 24. The intermediate plys 8 can be composed of ceramic or of poorly conductive metal. In the embodiment of the invention, they are only stressed for pressure, so that no particular demands with respect to the stability must be made of the material of these intermediate plys.

The illustrated embodiment yields four conductor loops, of which respectively two conductor loops lying opposite one another with respect to the rotational axis of the contact generate a magnetic field of the same direction and, therefore, are numbered with the same reference 11 or 12. The neighboring conductor loops generate a magnetic field of the opposite direction. In this arrangement, the individual conductor loops 11, 12 need not be isolated from one another, so that the compact, mechanically stable embodiment of the invention is possible. The number of conductor loops produced in such fashion is fundamentally not limited. Advantageously, for example, two semi-circular conductor loops can also be formed.

Shown as a contact member in the illustrated example is a pot contact 3 comprising an obliquely slotted cylinder wall and a contact disk 4, whereby the contact disk 4 can be a circular disk or a ring comprising a coaxial hole which is relatively small in comparison to the circumference. Instead of the slotted pot contact, a plate contact, for example, can also be employed, whereby the structural height of the contact and, thus, its mass can be reduced.

A simple manufacturability of the contact is guaranteed by the disposition of the slots 9 between the individual terminals 6, 7 and, at the same time, the possibility is opened up of matching the expanse of the webs 10 in axial direction to the expanse of the ring regions 5. In the illustrated example, the terminals 6, 7 with the intermediate plys 8 and the conductor loops 11, 12 have the same dimensions in axial direction. Thus, not only is a contacting with planar surfaces of the stud or of the contact member possible but, rather, a very small distance from the contact member is also possible. A relatively great field strength in axial direction in the region of the contact surface thereby derives, particularly given flat contact members.

The coaxial bore 16 serves as a centering bore when welding or soldering the conductor loops to the stud or the contact member. The bore 16 can also serve for the acceptance of a fastening screw 25 which connects the contact member and the conductor loops to the stud.

Figure 4:
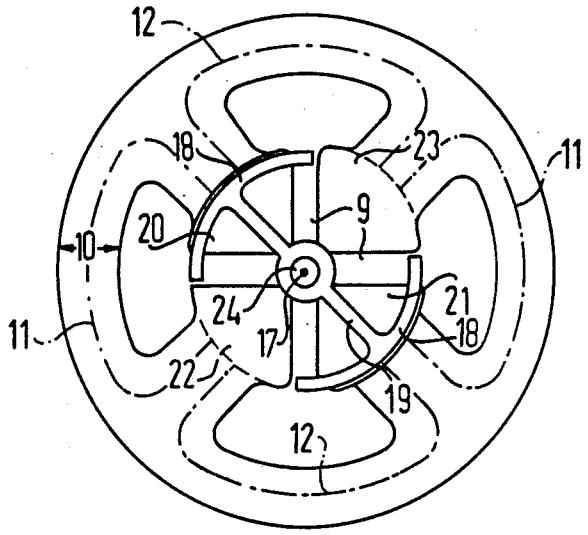
FIG. 4 is an end view of an alternate embodiment of the switch contact.
Figure 5:
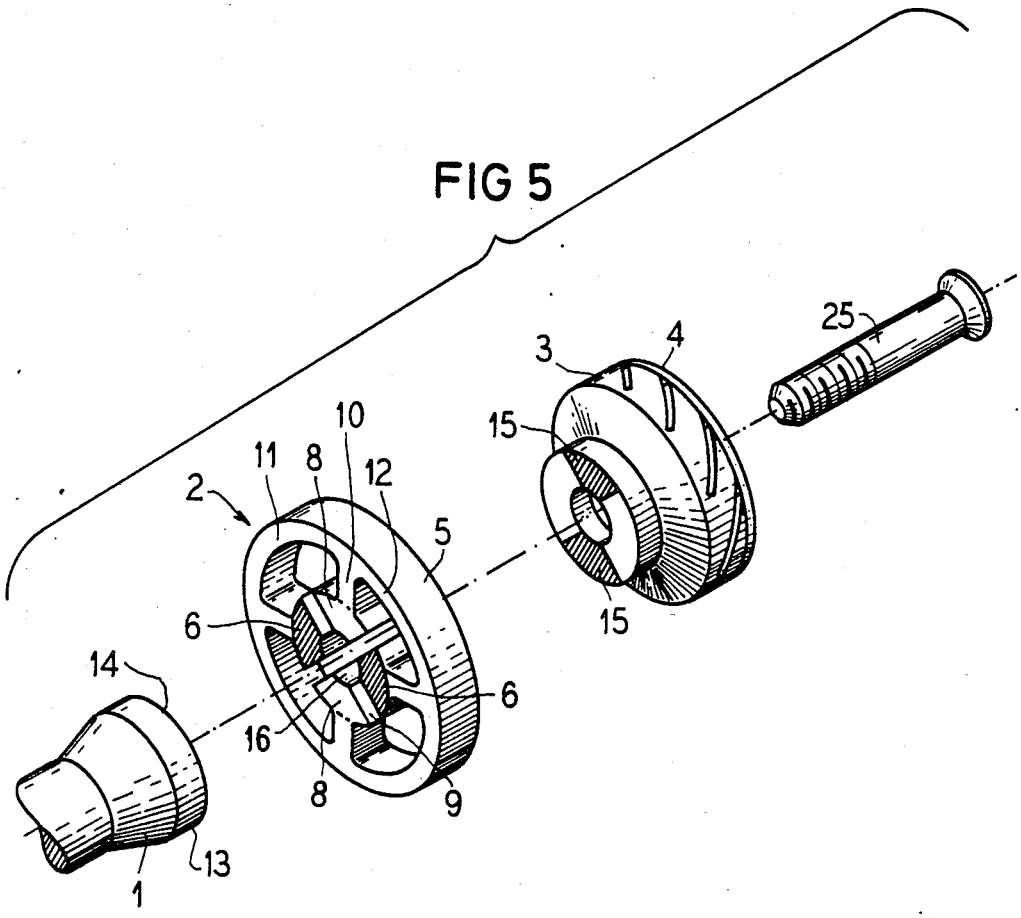
FIG. 5 is a perspective exploded view of the switch contact of FIG. 1.

An embodiment having great mechanical stability and a small electrical shunt to the conductor loops through the intermediate plys is established when the intermediate plys of FIG. 4 are fashioned of one piece for two terminals 20, 21 lying opposite one another with respect to the contact axis and have the form of two ring sectors 18 which are connected to one another by a web 19 embracing the contact axis 17. A bore 16 in the web 19 and in the terminals 20 through 23 lying therebelow serves the purpose of mutual centering of the intermediate ply 18 and 19, the terminals 20 through 23 and, potentially, the contact member 3 and the stud 1.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In a switch contact for a vacuum switching tube comprising a means for generating an axial magnetic field which comprises a stud, a contact member having at least one contact surface and two or more conductor loops at the side of the contact member facing away from the contact surface, said conductor loops generating a magnetic field proceeding in axial direction over the contact surface, said conductor loops proceeding from the stud and returning to a region of the switch member close to the axis and comprising terminals separated from one another by a slot, said terminals of the conductor loops being supported in the direction toward and in the proximity of the axis of the stud by a supporting member having poor to no electrical conductivity and said conductor loops being connected to one another of one piece at least in their part remote from the axis, the improvement comprising said conductor loops containing at least approximately circular sector-shaped terminals; said terminals merging into webs which belong to two neighboring conductor loops; terminals following one another in circumferential direction with surfaces being alternately connected electrically conductive in low-resistant fashion to the end face of the stud or to the terminal surface of the contact member; and said slots between said terminals separating supporting surfaces opposite to the low-resistant contacted surfaces of the terminal and contacted in high-resistant fashion.

2. A switch contact according to claim 1, wherein the slots lie parallel to a plane which contains the rotational axis of the switch contact.

3. A switch contact according to claim 2, wherein the symmetry plane of the slots contains the rotational axis of the switch contacts.

4. A switch contact according to claim 1, wherein intermediate plys of a non-conductive material or of a poorly conductive material are disposed on the supporting surfaces of that side of the terminals contacted in high-resistant fashion.

5. A switch contact according to claim 1, wherein the conductor loops form a common circular ring and webs applied thereto; and in that the webs comprise the same expanse in axial direction as the circular ring.

6. A switch contact according to claim 5, wherein the webs are twice as wide as the circular ring.

7. A switch contact according to claim 1, wherein the terminals comprise supporting surfaces set back in axial direction relative to the surface of neighboring terminals; and in that the intermediate plys terminate in axial direction in a plane in common with the neighboring terminals.

8. A switch contact according to claim 7, wherein intermediate plys for two terminals lying opposite one another with respect to the contact axis are formed of one piece and have the shape of two ring sectors which are connected to one another by a web proceeding through the contact axis.

9. A switch contact according to claim 1, wherein the stud has a part with enlarged cross-section and adjoining its end face applied to it; and in that the terminals of the conductor loops cover this enlarged cross-section.

* * * * *